US005884334A

United States Patent [19]

Collette et al.

[11] Patent Number: 5,884,334

[45] Date of Patent: Mar. 23, 1999

[54] FISHING HAT AND SUN SHADE

[76] Inventors: Kenneth F. Collette; Karla J. Collette, both of 1110 SW. 14th Ter., Fort Lauderdale, Fla. 33312

[21] Appl. No.: 943,456

[22] Filed: Oct. 3, 1997

[51] Int. Cl.[6] ..... A42B 1/06

[52] U.S. Cl. ..... 2/195.1; 2/10; 2/172

[58] Field of Search ..... 2/10, 195.1, 195.5, 2/195.6, 172

[56] References Cited

U.S. PATENT DOCUMENTS

| | | | |
|---|---|---|---|
| 419,765 | 1/1890 | Frank . | |
| 1,356,542 | 10/1920 | McNeill . | |
| 1,486,098 | 3/1924 | McGaffey . | |
| 1,557,375 | 10/1925 | Stern . | |
| 2,417,986 | 3/1947 | Marder et al. | 2/198 |
| 2,697,835 | 12/1954 | Stone | 2/195.5 |
| 2,717,385 | 9/1955 | Linster | 2/10 |
| 4,321,708 | 3/1982 | Troiano | 2/10 |
| 4,541,125 | 9/1985 | Phillips | 2/10 |
| 4,839,924 | 6/1989 | Laurence | 2/10 |
| 4,852,882 | 8/1989 | Otsuka et al. | 273/183 B |
| 4,982,449 | 1/1991 | Finkelstein | 2/195.6 |
| 5,007,110 | 4/1991 | Gilbert | 1/10 |
| 5,572,745 | 11/1996 | Mainus | 2/195.1 |

*Primary Examiner*—Diana L. Biefeld
*Attorney, Agent, or Firm*—Christie, Parker & Hale, LLP

[57] ABSTRACT

A fishing hat comprises a crown, having a front and back, and a bill and blinder assembly. The bill and blinder assembly is made of a single piece of semi-rigid material and comprises a bill and two side blinders, each side blinder having front and back edges. The bill has a length ranging from about 95 mm to about 115 mm.

A sun shade for use with the fishing hat comprises a fabric and a holding means fixedly attached to the fabric. The holding means comprises a band that can be situated on and wrapped around the wearer's head such that the single fabric covers the wearer's ears and neck.

20 Claims, 5 Drawing Sheets

8
10
12
14
16
20
22
22
22
24
B

FISHING HAT AND SUN SHADE

BACKGROUND OF THE INVENTION

The present invention is directed to a fishing hat and sun shade particularly useful for sightfishing. Sightfishing is generally done in shallow water, usually from about six inches to about six feet deep. Sightfishing requires the fisherman to see the fish and present the bait or fly to a particular fish or target, such as a specific log or rock where fish may lay.

Seeing the fish is sometimes difficult because of sunlight reflecting off the water. Additionally, obstacles, such as moving or choppy water, make it difficult for the fisherman to see in the water. With saltwater sightfishing, many factors create movement, such as the wind, the tide, the current, the boat and the fish. In freshwater fishing, the rocks and logs on the bottom of the rivers and streams, as well as the high speed of the water, create ripples on the surface, again making it difficult for the fisherman to see through the water. When the water is clear, the surface glare and reflection make seeing even more difficult.

For years people have shielded their eyes from the sun by creating a shade with their hand above their eyes, thus leading to the creation of the hat bill. And for years fisherman have created peripheral shade with their hands cupped around their eyes. A need was thus created for a hat that incorporates both types of shade while leaving the wearer's hands free for other uses.

Currently available hats do not adequately block the sun, making it difficult for the fisherman to see the fish. For ideal vision, a fisherman would look through a tunnel that extends from his eyes to the water. The more the peripheral light is eliminated, the better the vision is. Additionally, it is desirable to have increased eye protection from the sun, hooks and lures.

Thus, a suitable sightfishing hat creates a tunnel effect while providing an aesthetically pleasing design. A hat that provides a shaded area around the face allows the wearer to see through the water without eye strain and provides much more clarity. Additionally, a fishing hat should be constructed of such a material so that it can float in the water in the case that it is blown off the fisherman's head.

SUMMARY OF THE INVENTION

One aspect of the present invention is a hat useful for sightfishing comprising a crown and a bill and blinder assembly to create a tunnel effect. The bill and blinder assembly, which comprises a bill and two side blinders, is made of a single piece of semi-rigid material. The junctions between the bill and side blinders are formed by perforating the semi-rigid material. The use of a single semi-rigid material to form the bill and side blinders permits the blinders to be adjusted to create the desired tunnel effect while not uncomfortably resting on the wear's cheeks. The semi-rigid material also allows the blinders to stay in place once adjusted, and thus not distract the wearer by, for example, blowing in the wearer's face.

To create the desired tunnel effect, the bill is longer than that on a typical cap, preferably having a length ranging from about 95 mm to about 115 mm. Additionally, the bill is designed to remain relatively flat, rather than forming a concave shape, when placed on the wearer's head. The flat bill adds to the desired tunnel effect.

Additionally, the construction and materials used to make the hat allow the hat to float in the water in the event that the hat is blown off the fisherman's head.

Another aspect of the present invention is a hat further comprising a sun border. The sun border comprises a single piece of flexible material attached to the sides and back section of the lower edge of the crown of the hat. The sun border protects the ears and part of the neck from sun damage. When not in use, the sun border can be folded up along the crown of the hat.

Another aspect of the present invention is a sun shade also for protecting the ears and neck from sun damage. The sun shade can be used alone, in connection with the above-described hat, or in connection with any other hat. The sun shade comprises a fabric having end sections, a midsection and top and bottom edges, and a holding means fixedly attached at or near the top edge of the fabric. The single fabric covers the sides and back of the head, generally extending from ear to ear. The end sections of the fabric, which cover the ears, are shorter than the midsection, which covers the neck. The holding means comprises a band that can be situated on and wrapped around the wearer's head such that the single fabric covers the wearer's ears and neck. The holding means can comprise a cord running through a sleeve situated near the top edge of the fabric. The cord can be adjusted using an adjusting means to fit comfortably on the wearer's head. A preferred adjusting means comprises a bead having a hole through which the ends of the cord extend. Alternatively, the holding means can comprise a stretchable band.

DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
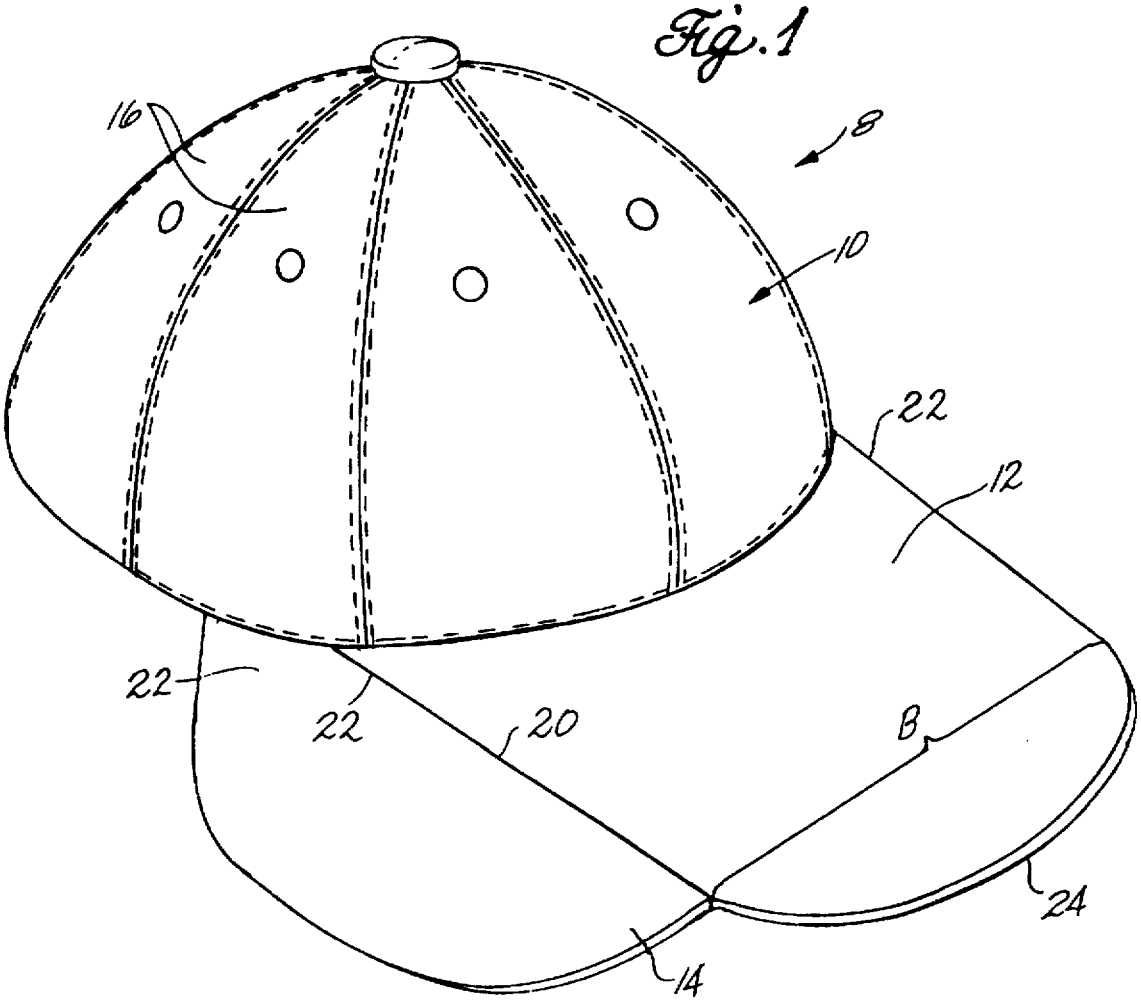
FIG. 1 is an elevation view of a hat according to the invention.
Figure 2:
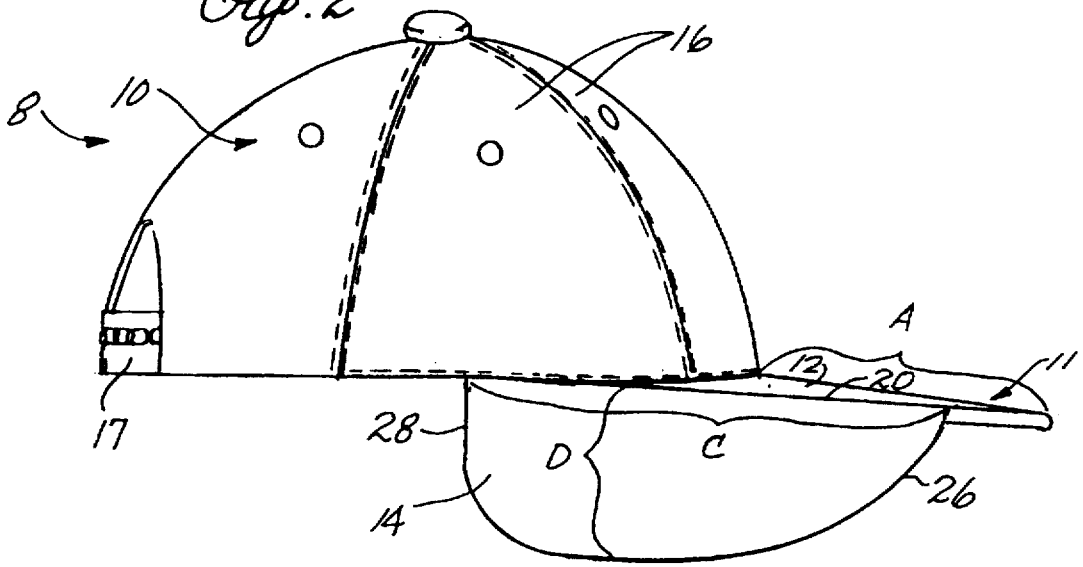
FIG. 2 is a side view of a hat according to the invention.

In a particularly preferred embodiment of the invention, there is provided a fishing hat 8. As shown in FIGS. 1 and 2, the fishing hat 8 comprises a crown 10 having a front side and a back side and a bill and blinder assembly 11.

The crown 10 is generally semispherically-shaped and has a plurality of panels 16. The panels 16 can be made of any suitable fabric, preferably a lightweight and generally washable fabric, and more preferably a cotton twill fabric. Alternatively, one or more panels 16 can be made of a nylon mesh. The panels 16 are sewn together or otherwise fixedly attached by any suitable means. The crown can alternatively comprise a single generally semispherically-shaped fabric rather than a plurality of panels 16. The precise structure of the crown 10 is not critical to the present invention.

The size of the crown 10 is not critical to the invention, but should be appropriate to fit comfortably on a human head. Located at the back side of the crown 10 is a standard adjustment strap 17, as is known in the art, for allowing a single-sized hat to fit different sized heads. Alternatively, the crown 10 can be designed in different sizes for different sized heads.

Attached to the front side of the crown 10 is the bill and blinder assembly 11. The bill and blinder assembly 11 comprises a bill 12 and two side blinders 14. The bill and blinder assembly 11 is made from a single piece of semi-rigid material. The semi-rigid material is one that is bendable, i.e., capable of adjusting to fit the individual wearer, while being capable of staying in place once bent. The material is preferably also floatable. A preferred material is polypropylene. When the hat 8 is placed on the head, the plane of the bill 12 remains relatively flat, i.e., does not form a concave shape.

The semi-rigid material of the bill and blinder assembly 11 should be covered with a second material, preferably a fabric to match the crown, which in a preferred embodiment is cotton twill. The second material can be attached to the bill by any suitable means, but is preferably sewn rather than attached by an adhesive.

The bill 12 is connected to the side blinders 14 at folds 20. The folds 20 are formed by perforating the single piece of semi-rigid material at the junctions between the bill 12 and the side blinders 14. Accordingly, the side blinders 14 can be bent inward and outward to allow the wearer to adjust the side blinders 14 to come close to his cheek to eliminate peripheral glare and light. However, the bill and blinder assembly 11 must be sufficiently rigid so that the side blinders 14 do not flap in the wearer's face and so that the side blinders 14 stay in place when adjusted. Preferably the side blinders 14 can be adjusted to form an angle with the underside of the bill 12 ranging from about 75 degrees to about 160 degrees, more preferably from about 90 degrees to about 120 degrees.

The bill 12 has two straight sides 22 and a rounded front 24. The sides 22 each have a front end and a back end such that the width of the bill 12 between the front ends of the sides 22 is the same as its width between the back ends of the sides 22. Alternatively, the front 24 can be straight, but a rounded front is preferred because it creates a better tunnel effect.

The bill 12 is relatively long to create the desired tunnel effect. Preferably the bill has a length, measured from the front side of the crown 10 to the end of the bill (line A), of from about 95 mm to about 115 mm, more preferably from about 100 mm to about 110 mm, and still more preferably about 105 mm. The bill 12 has a width, measured between the front edges of the blinders 14 (line B), similar to the width of the crown 10, preferably from about 150 mm to about 190 mm, more preferably from about 160 mm to about 180 mm, and still more preferably about 170 mm.

The side blinders 14 preferably have a rounded front edge 26 with a relatively straight back edge 28. Other similar shapes can be used, but the rounded front edge 26 is preferred because it creates a better tunnel effect. The side blinders 14 extend from the front end of the sides 22 of the bill 12 to a point on the crown 10 that is not quite midway around the side of the crown 10. The side blinders 14 preferably have a length, measured along the top edge of the side blinders 14 (line C), of from about 130 mm to about 170 mm, more preferably from about 140 mm to about 160 mm, and still more preferably about 150 mm. The side blinders 14 have a width, measured from the fold 20 to the lowest point on the blinder 14 (line D), sufficient to adequately block out the sun without resting on the wearer's cheek. Preferably the width of each side blinder 14 is from about 50 mm to about 80 mm, more preferably from about 60 mm to about 75 mm and still more preferably about 65 mm.

Figure 3:
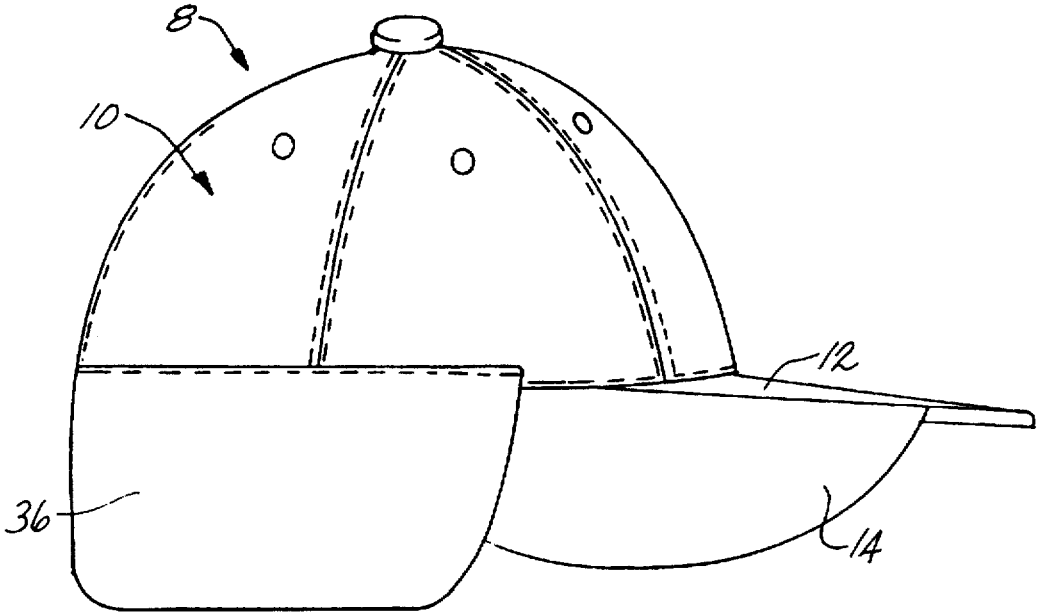
FIG. 3 is a side view of a hat according to the invention having a sun border.

In another embodiment, as shown in FIG. 3, the hat 8 further comprises a sun border 36. The sun border 36 comprises a single piece of material having two ends, a midsection and top and bottom edges. The top edge of the sun border 36 is sewn or otherwise fixedly attached to the base of the crown 10 such that the midsection of the single piece of material is situated near the back of the crown and the two ends of the single piece of material are situated near the back edges 28 of the side blinders 14. The distance between the top edge and bottom edge of the sun border 36 preferably is shorter near the ends, e.g., from about 0.5 to about 1.0 inch, and longer near the middle, e.g., from about 2 to 3 inches.

The sun border 36 does not affect vision, but provides sun protection to the ears and neck. The sun border 36 can be folded up against the crown 10 away from the ears and neck when not in use. The sun border 36 can be made of any suitable fabric, and is preferably made of the same fabric as the crown 10.

Another aspect of the present invention is a sun shade 40. The sun shade 40, like the sun border 36, does not affect vision, but provides sun protection to the ears and neck. The sun shade 40 can be used either alone or in combination with the fishing hat 8 described above.

The sun shade comprises a lightweight fabric 42, such as cotton or polyester, having two end sections 44, a midsection 46, a top edge 48 and a bottom edge 50. Preferably the fabric 42 comprises a single piece of material, but can alternatively comprises two or more pieces of materials fixedly attached, e.g. sewn, to each other. The fabric 42 covers the sides and back of the head, generally extending from ear to ear. The two end sections 44 are intended to cover the ears while the midsection 46 is intended to cover the neck. Thus, the length of the fabric at the two end sections 44 is shorter than the length of the fabric at the midsection 46. Preferably the end sections 44 each have a rounded, angled front edge 45. The length of the midsection (line E) is preferably from about 9 to about 15 inches, more preferably from about 11 to about 13 inches. The length of the end sections 44, as well as the extent of the angle of the front edges 45 is not critical, but is preferably designed so that the ears are covered without extra fabric hanging near the wearer's face to block peripheral vision.

The top edge of the fabric 42 has a width such that, when the midsection of the fabric 42 is situated at the back of the head, the sides of the fabric 42 are situated near the ears. Preferably the top edge of the fabric has a width of from about 18 to about 25 inches, more preferably from about 19 to about 22 inches.

The sun shade 40 also comprises a holding means for keeping the single fabric 42 on the wearer's head. The holding means comprises a band that can be situated on and wrapped around the wearer's head such that the single fabric covers the wearer's ears and neck.

Figure 4:
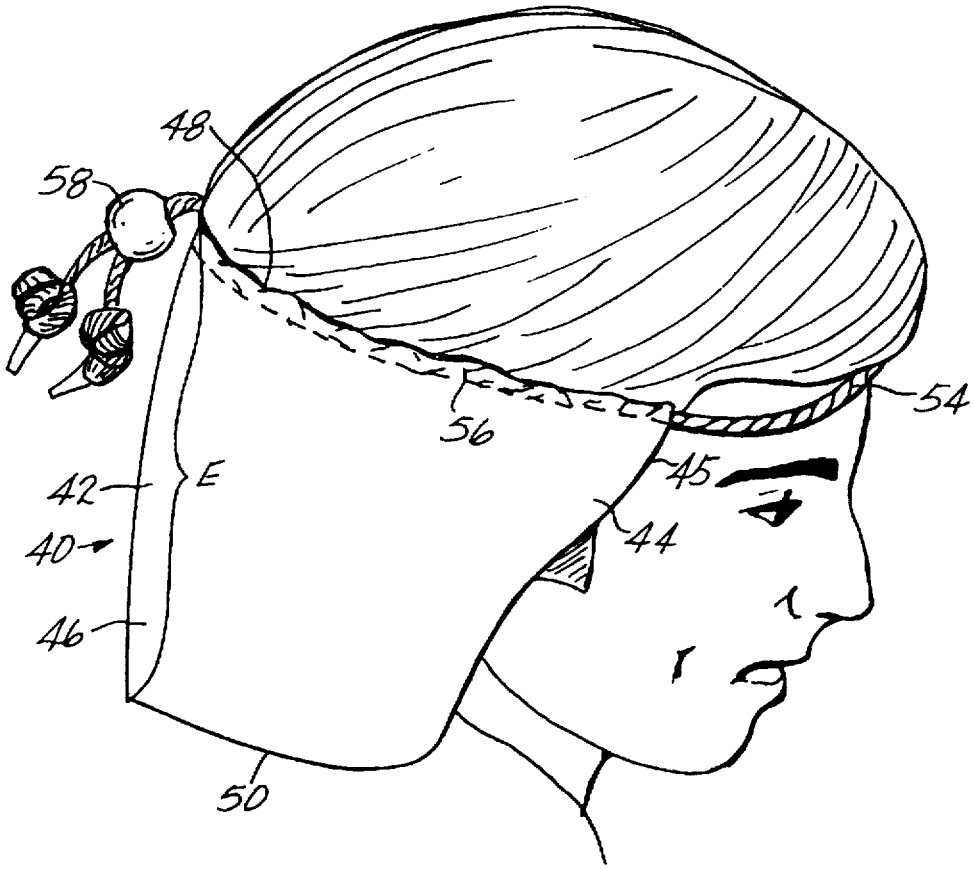
FIG. 4 is a side view of an embodiment of a sun shade according to the invention comprising a cord, situated on a wearer's head.

In one embodiment, as shown in FIG. 4, the holding means comprises a cord 54 having a midsection and two ends. The cord 54 is fixedly attached at or near the top edge of the fabric. Preferably the cord is incorporated into a sleeve 56 sewn into the fabric near its top edge, preferably along the full length of the top edge. The ends of the cord 54 are situated at or near the middle of the top edge of the fabric 42, and the midsection of the cord 54 is preferably located between the two end sections 44 of the fabric 42. The cord 54 can be made of any suitable material, such as cotton.

Additionally, the cotton cord can be covered with a second material having an aesthetically pleasing design.

The length of the cord 54 is greater than the circumference of a human head measured at a point above the eyebrows. Preferably the length of the cord 54 is at least about 28 inches, more preferably about 30 to about 40 inches, and still more preferably about 36 inches.

Also provided is an adjusting means for adjusting the length of the cord 54 that is between the ends of the fabric so that the cord 54 can be tightened and loosened around the head as desired. Preferably the adjusting means comprises a bead 58 having at least one hole through which the two ends of the cord 54 run. The hole preferably has a diameter such that the two ends of the cord 54 fit tightly within the hole. Thus, the bead 58 can be slid along the cord 54 when some force is applied but will not slide along the length of the cord 54 once situated in place. The ends of cord 54 are larger in diameter than the hole so that the bead 58 cannot be removed from the cord 54.

Figure 5:
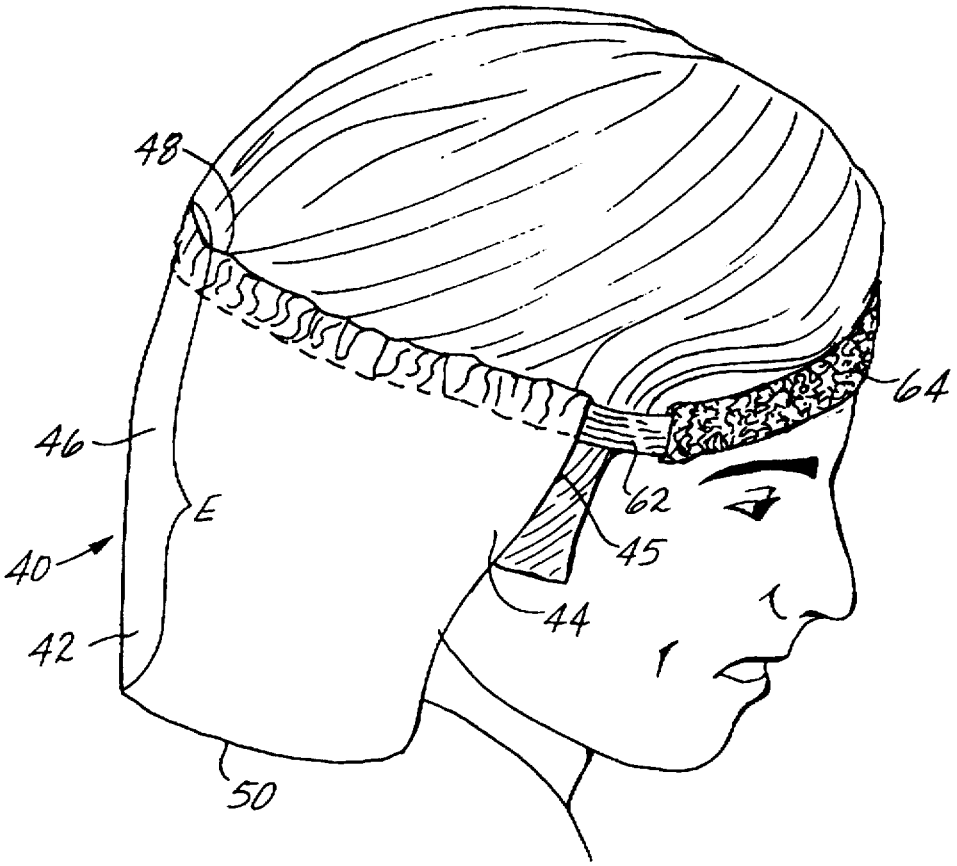
FIG. 5 is a side view of an embodiment of a sun shade according to the invention comprising a stretchable band, situated on a wearer's head.

In an alternative embodiment, as shown in FIG. 5, the holding means comprises a stretchable band 62. The stretchable band 62 can be sewn directly to the single fabric 42, or otherwise fixedly attached thereto, near the top edge of the fabric. The stretchable band 62 comprises a single piece of stretchable material, preferably elastic, connected at its two ends so as to form a continuous band. The stretchable band preferably has a length of at least about 24 inches, more preferably from about 28 to about 40 inches. The section of the stretchable band that is situated between the end sections 44 of the fabric 42, i.e., that is situated near the wearer's forehead, is preferably covered with a sweatband 64. The sweatband 64 can be made of any suitable material that provided comfort to the wearer, and is preferably made of an elasticized terry cloth.

The inventive hat and sun shade are not limited to sightfishing, but are also useful for other types of fishing. The inventive hat and sun shade can also be used for other outdoor activities where it is desirable to reduce sunlight and glare and/or to protect against sun damage, such as golfing and shooting.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention. Accordingly, the foregoing description should not be read as pertaining only to the precise structures described and illustrated in the accompanying drawings, but rather should be read consistent with and as support to the following claims which are to have their fullest and fair scope.

We claim:

1. A hat comprising a crown, having a front and back, and a bill and blinder assembly fixedly attached to the crown, wherein the bill and blinder assembly is made of a single piece of semi-rigid material and comprises a bill and two side blinders, each side blinder having front and back edges, and wherein the bill has a length ranging from about 95 mm to about 115 mm.

2. A hat according to claim 1 wherein the bill has a length ranging from about 100 mm to about 110 mm.

3. A hat according to claim 2 wherein the bill has a length of about 105 mm.

4. A hat according to claim 1 wherein the semi-rigid material is polypropylene.

5. A hat according to claim 1 wherein the bill has a width ranging from about 150 mm to about 190 mm.

6. A hat according to claim 5 wherein the bill has a width ranging from about 160 mm to about 180 mm.

7. A hat according to claim 6 wherein the bill has a width of about 170 mm.

8. A hat according to claim 1 wherein the side blinders have a length ranging from about 130 mm to about 170 mm.

9. A hat according to claim 8 wherein the side blinders have a length ranging from about 140 mm to about 160 mm.

10. A hat according to claim 9 wherein the side blinders have a length of about 150 mm.

11. A hat according to claim 1 wherein the side blinders have a width ranging from about 50 mm to about 80 mm.

12. A hat according to claim 11 wherein the side blinders have a width ranging from about 60 mm to about 75 mm.

13. A hat according to claim 12 wherein the side blinders have a width of about 65 mm.

14. A hat according to claim 1 wherein the bill has two straight sides, each having a front end and a back end, and wherein the width of the bill between the front ends of the sides is the same as the width of the bill between the back ends of the sides.

15. A hat according to claim 1 wherein the junctions between the bill and the side blinders is formed by perforations in the semi-rigid material.

16. A hat according to claim 1 wherein the hat further comprises a second material covering the semi-rigid material of the bill and blinder assembly.

17. A hat according to claim 16 wherein the second material is sewn to the semi-rigid material.

18. A hat according to claim 1, further comprising a sun border, wherein said sun border comprises a single piece of material having two ends, a midsection and top and bottom edges, and wherein the top edge of the sun border is fixedly attached to the base of the crown such that the midsection of the material is situated near the back of the crown.

19. A hat according to claim 18 wherein the ends of the single piece of material of the sun border are situated near the back edges of the side blinders.

20. A hat comprising a crown, having a front and back, and a bill and blinder assembly fixedly attached to the crown, wherein the bill and blinder assembly is made of a single piece of semi-rigid material and comprises a bill and two side blinders, each side blinder having front and back edges, wherein the junctions between the bill and the side blinders are formed by perforations in the semi-rigid material, and wherein the bill has a length ranging from about 95 mm to about 115 mm.

* * * * *